US006125804A

United States Patent [19]

Kawai et al.

[11] Patent Number: 6,125,804

[45] **Date of Patent: *Oct. 3, 2000**

[54] VARIABLE VALVE LIFT DEVICE

[75] Inventors: Yoshiyuki Kawai; Eiji Miyachi; Kazunari Adachi, all of Aichi-ken; Masahiro Nagae, Shizuoka-ken, all of Japan

[73] Assignee: Aisen Seiki Kabushiki Kaisha, Aichi-ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/151,668

[22] Filed: Sep. 11, 1998

[30] Foreign Application Priority Data

Sep. 12, 1997 [JP] Japan ..... 9-248719

[51] Int. Cl.[7] ..... F01L 13/00; F01L 1/14

[52] U.S. Cl. ..... 123/90.16; 123/90.48

[58] Field of Search ..... 123/90.15, 90.16, 123/90.17, 90.48, 198 F

[56] References Cited

U.S. PATENT DOCUMENTS

| | | | |
|---|---|---|---|
| 5,488,934 | 2/1996 | Shirai et al. | 123/90.16 |
| 5,558,052 | 9/1996 | Schwarzenthal et al. | 123/90.16 |
| 5,603,293 | 2/1997 | Schwarzenthal et al. | 123/90.16 |
| 5,603,294 | 2/1997 | Kawai | 123/90.16 |
| 5,615,651 | 4/1997 | Miyachi | 123/198 F |
| 5,782,216 | 7/1998 | Haas et al. | 123/90.16 |

FOREIGN PATENT DOCUMENTS

| | | |
|---|---|---|
| 8-42315 | 2/1996 | Japan . |
| 8-189316 | 7/1996 | Japan . |
| 8-218834 | 8/1996 | Japan . |

*Primary Examiner*—Weilun Lo

*Attorney, Agent, or Firm*—Reed Smith Hazel & Thomas LLP

[57] ABSTRACT

A variable valve lift device (20) provided in a bore (21) of a cylinder head (11) to open and close a valve (24) in accordance with a rotation of a cam (13, 14, 15) comprises an outer body (22) driven by the cam (13, 14, 15) and slidably provided in the bore (21); an inner body (23) connected to the valve (24) and slidably provided in the outer body (22); a restricting member (26) for restricting mutual displacement between the outer body (22) and the inner body (23); and a synchronizing member (36) slidably provided in the inner body (23) and for controlling the restricting member (26) based on inertia applied thereto. In the present invention, the restricting member (26) is controlled by the synchronizing member (36). The synchronizing member (36) detects the acceleration of the inner body (23) so that the restricting member (26) may restrict the mutual displacement between the outer body (22) and the inner body (23) in timely manner.

10 Claims, 5 Drawing Sheets

VARIABLE VALVE LIFT DEVICE

BACKGROUND OF THE INVENTION

This application claims priority under 35 U.S.C. §§119 and/or 365 to "THE VARIABLE VALVE LIFT DEVICE," Application No. H09-248719 filed in JAPAN on Sep. 12, 1997, the entire content of which is herein incorporated by reference.

This invention relates to a variable valve lift device for varying the opening and closing timing or amount of lift of intake and exhaust valves.

Japanese Laid-Open Patent Publication No. H08-189316 published on Jul. 23, 1996 or corresponding U.S. Pat. No. 5,603,294 published on Feb. 18, 1997 discloses a conventional variable valve lift device. In these publications, a lifter is provided to slide inside a bore that is formed in a cylinder head of an engine. The lifter includes an outer body and an inner body. An upper end of the outer body is in contact with a high speed cam. An upper end of the inner body is in contact with a low speed cam. A restricting member is mounted on the outer body to slide in perpendicular direction with respect to a valve stem. The restricting member may restrict mutual movements between the outer and inner bodies when the restricting member is engaged with the inner body. Further, a control member is provided to control the slide action of the restricting member. The control member may select one of two modes. In the high lift mode, the control member engages the restricting member with the inner body. In the low lift mode, the control member disengages the restricting member from the inner body.

Japanese Laid-Open Patent Publication No. H08-42315 published on Feb. 13, 1996 discloses a conventional variable valve lift device. In this publication, a cylindrical member is provided to slide inside a bore that is formed in a cylinder head of an engine. The cylindrical member is driven by a cam. In the cylindrical member, a piston, a restricting member and locking member are provided. The piston receives fluid pressures and selects one of two positions to switch lifting amount of a valve. The restricting member may be displaced under spring force to restrict the lifting amount of the valve. The locking member deforms in accordance with a locus of the cam to hold the restricting member at a position.

However, in the above conventional valve lifters, it is hard to timely switch the lifting amount so that the restricting member may not operate smoothly.

In Japanese Laid-Open Patent Publication No. H08-189316, such switching timing depends on an application timing of the fluid pressure. Therefore, the restricting member may interfere with the inner body if such switching timing overlaps with the lifting timing of the cam. Such interference may generate noise to deteriorate durability of the valve lifter. Such interference may also happen when the valve lifter is at the bottom dead center because the lifter is driven by a nose area of the cam and the inner and outer bodies may receive different forces from the nose area.

In Japanese Laid-Open Patent Publication No. H08-42315, a channel is provided on the cam to detect a rotational position of the cam. Such detection may require a complex system to increase the cost of the valve lifter.

Accordingly, a feature of the present invention is to provide a variable valve lift device to solve the above conventional drawbacks.

Further, a feature of the present invention is to switch lifting amount in time.

Yet further, a feature of the present invention is to prevent the restriction member from interfering with the inner body.

To achieve the above features, a variable valve lift device provided in a bore of a cylinder head to open and close a valve in accordance with a rotation of a cam comprises:

- an outer body driven by the cam and slidably provided in the bore;
- an inner body slidably provided in the outer body, the inner body being connected to the valve;
- a restricting member for restricting mutual displacement between the outer body and the inner body; and
- a synchronizing member slidably provided in the inner body and for controlling the restricting member based on inertia applied thereto.

In the present invention, the restricting member is controlled by the synchronizing member. The synchronizing member detects the acceleration of the inner body so that the restricting member may restrict the mutual displacement between the outer body and the inner body in a timely manner.

DETAILED DESCRIPTION OF THE PREFERRED EMBODIMENT

Referring now to FIGS. 1 to 7, a preferred embodiment of the present invention is explained in detail.

Figure 1:
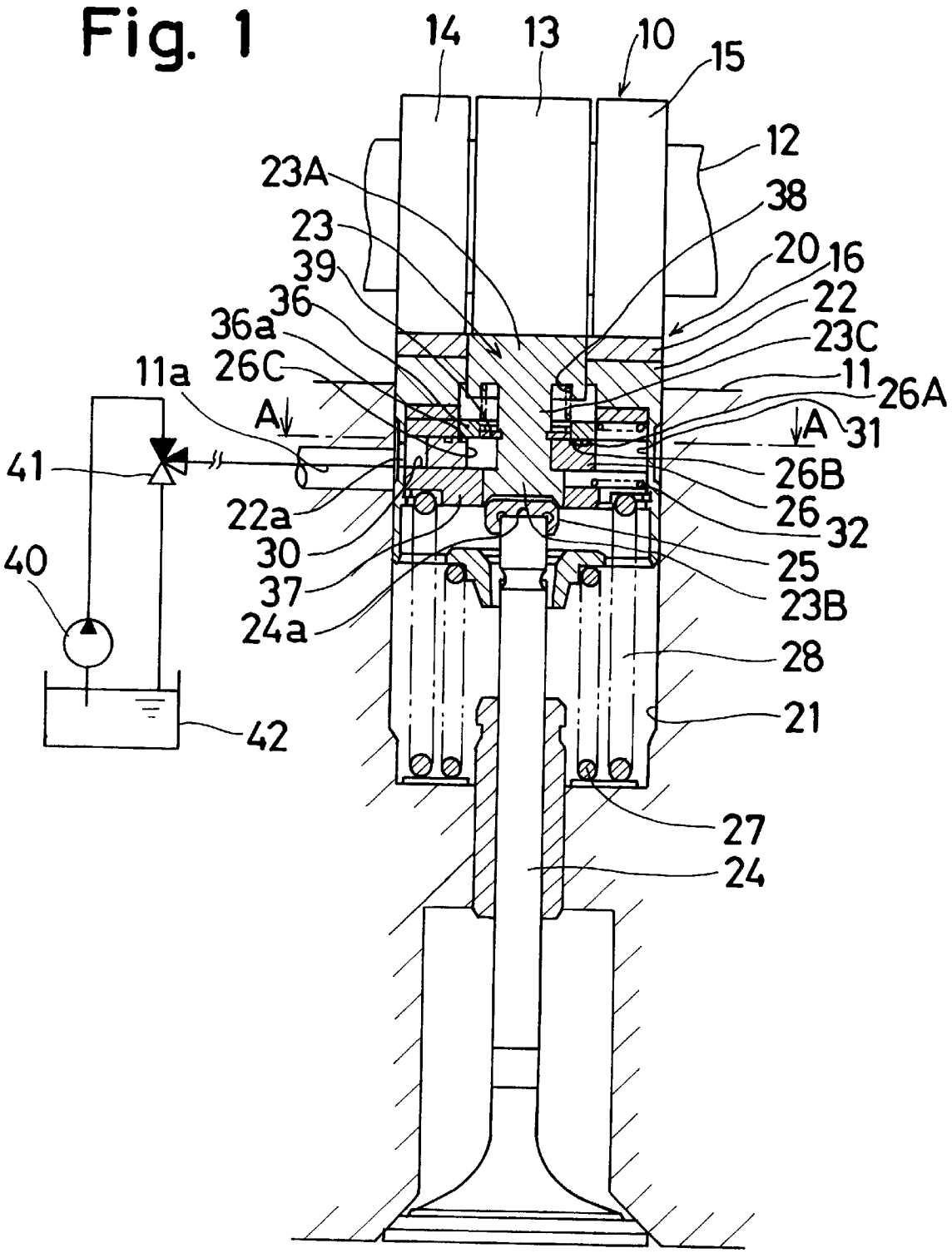
FIG. 1 shows a cross sectional view of the variable valve lifter for internal combustion engine according to the present invention.

FIG. 1 shows a cross sectional view of the variable valve lifter 20 in a stationary state. In FIG. 1, a cam shaft 12 is rotatably supported by the cylinder head 11 of an internal combustion engine. Three cams 13, 14 and 15 are integrally formed on the cam shaft 12. The low-speed cam 13 is provided for the low speed mode. The high-speed cams 14 and 15 are provided for the high speed mode. The low-speed cam 13 is provided between the high-speed cams 14 and 15.

A lifter 20 is inserted among the cams 13, 14, 15 and a stem 24. The lifter 20 comprises an outer body 22 and an inner body 23. The outer body 22 has a cylindrical shape with an upper bottom. The outer body 22 is inserted in a bore 21 and slides in the axial direction of the stem 24. The inner body 23 is inserted and slides in the outer body 22. The outer body 22 is driven by the high-speed cams 14 and 15. The inner body 23 is driven by the low-speed cams 13.

An end 24*a* of the stem 24 is in contact with the lower bottom of the inner body 23 through a shim 25. A downward force from the low-speed cam 13 is transmitted from the inner body 23 to the end 24*a* of the stem 24 through the shim 25. The inner body 23 is pressed upwardly toward the low-speed cam 13 by a compression spring 27. The outer body 22 is pressed upwardly toward the high-speed cams 14 and 15 by a compression spring 28. A ring shim 16 is pinched between the upper bottom of the outer body 22 and the high-speed cams 14, 15.

An intermediate member 37 is inserted in a hollow space between the outer body 22 and the inner body 23. The intermediate member 37 has a chamber extending in a perpendicular direction with respect to the stem 24. The chamber is divided into two pressure chambers 30 and 31 by a restricting member 26. Fluid is supplied to the pressure chamber 30 through a hole 22*a* from a lineage 11*a* formed in a cylinder block 11. A compression spring 32 is inserted in the pressure chamber 31.

Figure 2:
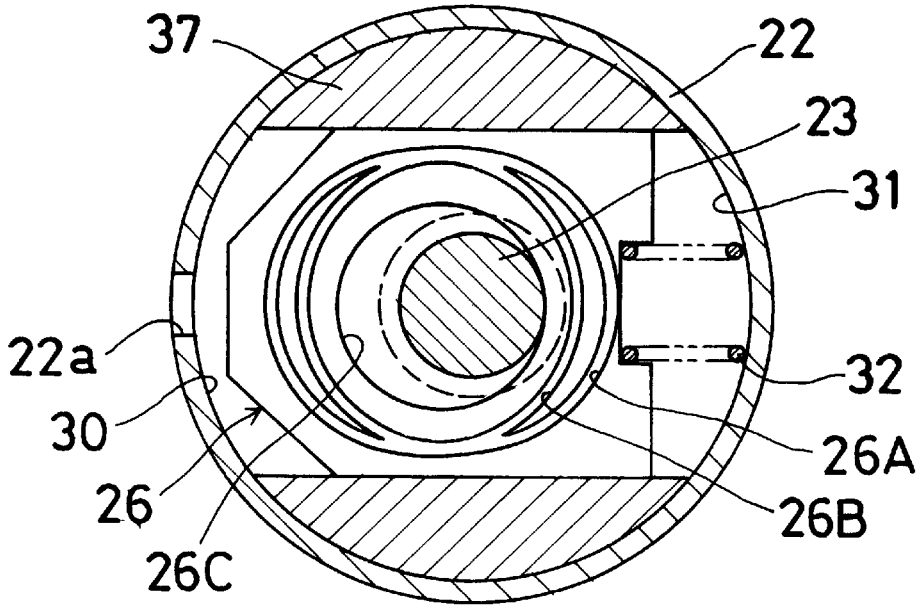
FIG. 2 shows a cross sectional view of the variable valve lifter taken along line A—A in FIG. 1.
Figure 3:
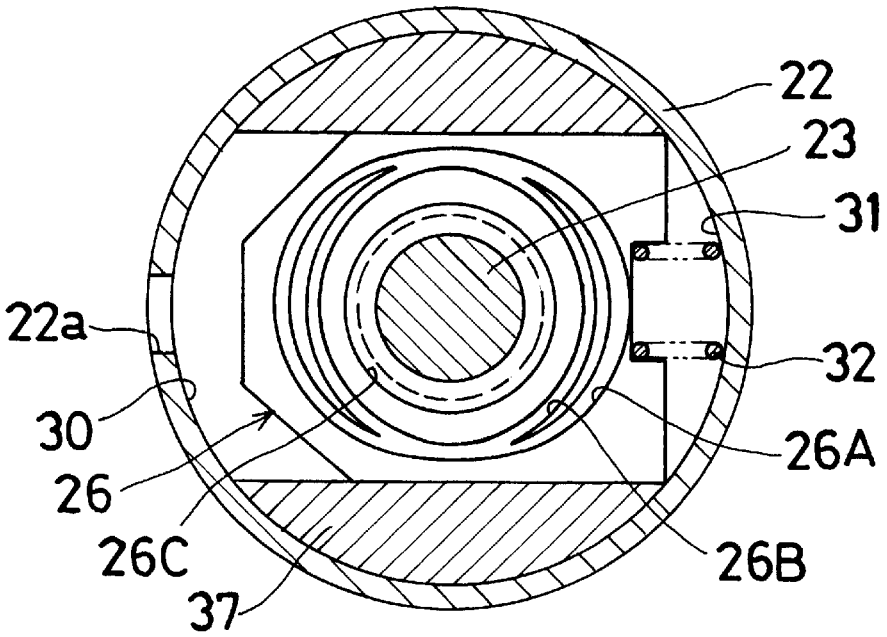
FIG. 3 shows a cross sectional view of the variable valve lifter taken along line A—A in FIG. 1.

The fluid is supplied from an oil pump 40 to the lineage 11*a* through a switching valve 41. The switching valve 41 is controlled by a controller (not shown) to select one of two positions in response to rotational speed of the engine. At the first position of the switching valve 41, the fluid is supplied from the pump 40 to the lineage 11*a* so that output port of the pump 40 is disconnected from an oil pan 42. At the second position of the switching valve 41, the output port of the pump 40 is disconnected from the lineage 11*a* and the fluid is drained from the lineage 11*a* to the oil pan 42. As shown in FIGS. 2 and 3, depending on the fluid pressure in the pressure chamber 30 and spring force of the compression spring 32, the restricting member 26 may slide in a perpendicular direction with respect to an axis of the inner body 23. FIG. 2 shows that the restricting member 26 gets a biased position where the axis of the center hole 26C is displaced from the axis of the inner body 23. FIG. 3 shows that the restricting member 26 gets the coaxial position where the axis of the center hole 26C is agreed with the axis of the inner body 23.

As shown in FIG. 1, the inner body 23 includes a disc-shaped upper end 23A, a disc-shaped lower end 23B and a rod portion 23C. The upper end 23A is in contact with the low-speed cam 13. The lower end 23B is in contact with a shim 25 that covers the end 24*a* of the stem 24. The rod portion 23C connects the upper end 23A and the lower end 23B. An external diameter of the lower end 23B is smaller than that of the upper end 23A. An external diameter of the rod portion is smaller than that of the lower end 23B.

An internal diameter of the center hole 26C of the restricting member 26 is larger than the diameter of the lower end 23B of the inner body 23. Accordingly, the lower end 23*b* of the inner body 23 may get into the central hole 26C of the restricting member 26 when the center hole 26C is coaxial to the inner body 23.

On the restricting member 26, two circular channels 26A and 26B are formed as shown in FIGS. 2 and 3. A radius of the circular channels 26A is the same as the radius of the circular channels 26B. The center of the first circular channel 26A is apart from the center of the second circular channel 26B with the maximum amount of displacement of the restricting member 26. As shown in FIG. 1, a synchronizing member 36 is slidably supported by the rod portion 23C of the inner body 23. A projection 36*a* is formed on the synchronizing member 36 to selectively engage with one of the circular channels 26A and 26B. A ring stopper 39 is fixed and projected from the rod portion 23C of the inner body 23. The synchronizing member 36 may slide between the ring stopper 39 and the upper end 23A of the inner body 23 along the rod portion 23C in the axial direction of the inner body 23. A spring 38 is inserted between the synchronizing member 36 and the upper end 23A of the inner body 23 to press the synchronizing member 36 toward the ring stopper 39. The ring stopper 39 is preferably provided away from the bottom of the upper end 23A of the inner body 23 to leave a little smaller distance than the natural head of the spring 38. Further, the position of the stopper 39 is selected so that the projection 36A of the synchronizing member 36 may be apart from the circular channels 26A and 26B of the restricting member 26 when the inner body 23 is mutually displaced with respect to the outer body 22.

The circular channels 26A and 26B cross at two points on the restricting member 26. The present lifter 20 may be rotated in the bore 21. The projection 36*a* of the synchronizing member 36 may be a circular or arc projection capable of engaging with the circular channels 26A and 26B.

Figure 4:
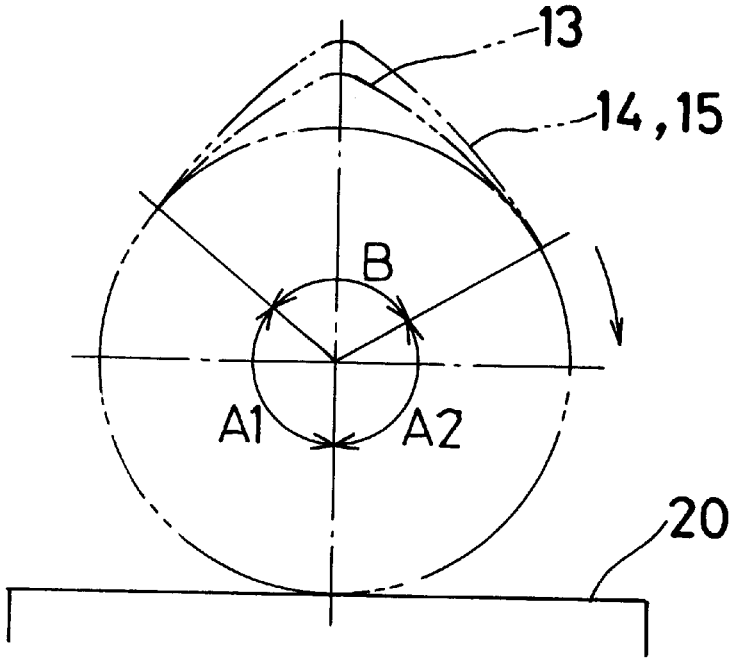
FIG. 4 shows a diagram explaining the relationship between switching timing and a locus of the cams.

FIG. 4 shows a diagram explaining the relationship between switching timing and locus of the cams 13, 14 and 15. The lifter 20 may have the low lifting mode and high lifting mode at the nose area B of the cams 13, 14 and 15. Under the low lifting mode, the inner body 23 may be mutually displaced with respect to the outer body 22. Under the high lifting mode, the inner body 23 may be displaced integrally with respect to the outer body 22. For example, under the high lifting mode, as shown in FIG. 1, the lower end 23B of the inner body 23 is always positioned under the restricting member 26 so that the inner body 23 moves integrally with the outer body 22. Further, the projection 36*a* of the synchronizing member 36 engages with the first circular channel 26A.

Figure 5:
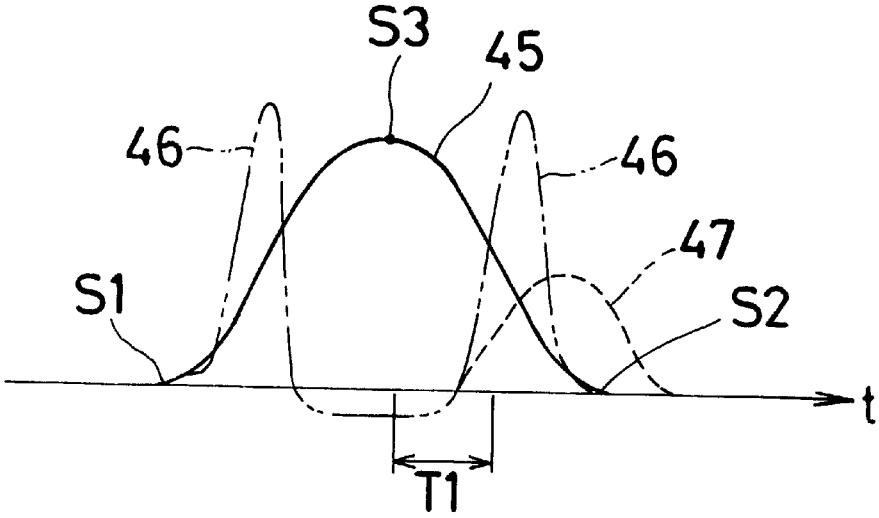
FIG. 5 is a timing chart showing relationships among the amount of valve lift, the angle of the cam and the acceleration acting on the synchronizing member.

Upon switching from the high lifting mode to the low lifting mode, the switching valve 41 is switched to the first position so that the output port of the oil pump 40 is connected to the lineage 1 la. Referring to FIG. 5, a curved line 45 shows a lifting amount under the high lifting mode. The bottom center S3 is also shown between top dead centers S1 and S2. Both the inner body 23 and the outer body 22 are in contact with the nose area B of the cams 13, 14 and 15 around the bottom center S3. A curved line 46 shows cam acceleration that agrees with the acceleration of the lifter 20. In other words, the lifter 20 increases upward acceleration during upward movement caused by the nose area B and the first half A1 of a base circle area. The lifter 20 increases downward acceleration during downward movement caused by the second half A2 of the base circle area and the nose area B.

In this embodiment, while the lifter 20 moves upwardly from the bottom dead center S3 to the top dead center S2, the synchronizing member 36 maintains the engagement between the projection 36*a* and the first circular channel 26A since both downward inertia and the spring 38 press the synchronizing member 36 to the ring stopper 39. In FIG. 5, a time period T1 shows such engagement period where the displacement of the restricting member 26 is prohibited by the synchronizing member 36.

Figure 6:
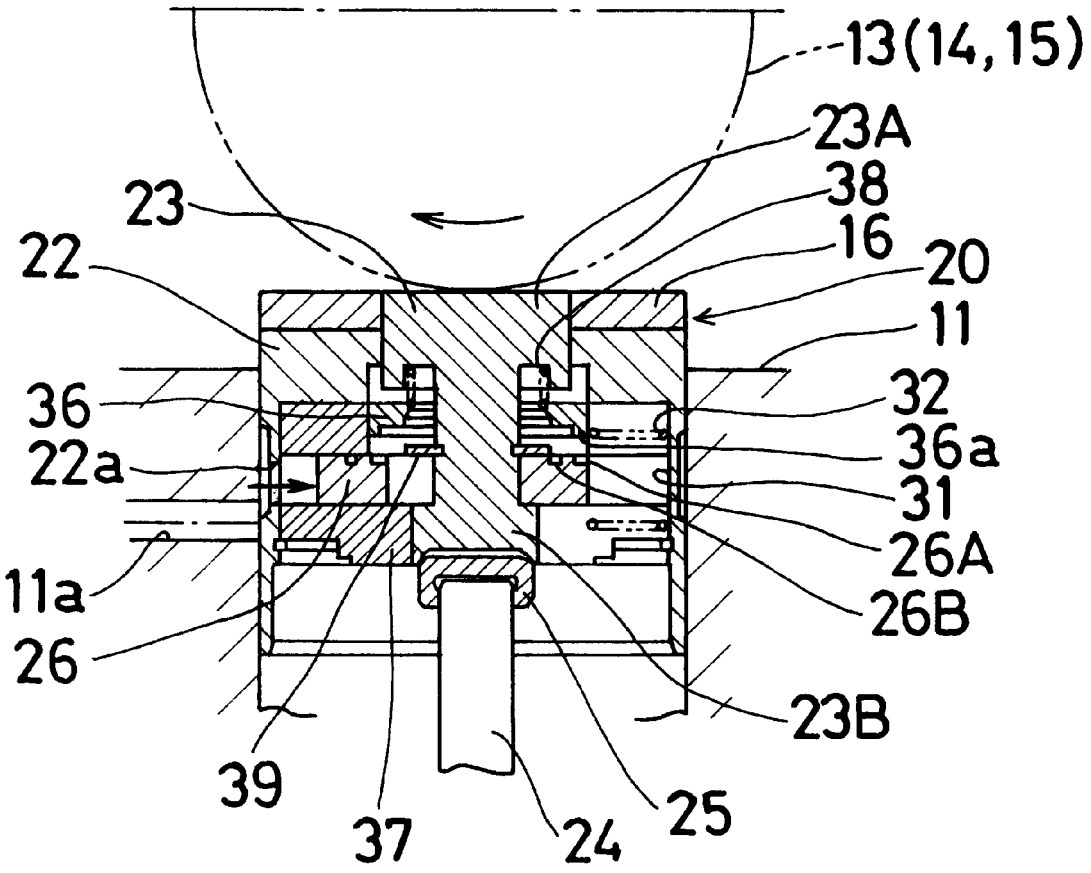
FIG. 6 shows a cross sectional view explaining the switching operation from the high lifting mode to the low lifting mode.

In FIG. 5, a curved line 47 shows upward inertia applied to the synchronizing member 36 while the first half A1 of the base circle area is in contact with the lifter 20 after the bottom dead center S3. The upward inertia applied to the synchronizing member 36 compresses the spring 38 so as to disengage the synchronizing member 36 from the restricting member 26 as shown in FIG. 6. Then, the top surfaces of the inner member 23 and the shim 16 become flat while the base circle area of the cams 13, 14 and 15 are in contact with the lifter 20. Under this condition, no force is applied to the restricting member 26 between the inner body 23 and the outer body 22 in the direction parallel to the axis of the inner body 23. Further, a displacement path for the restricting member 26 becomes straight in the intermediate member 37 and the lower end 23B. Therefore, the restricting member 26 is free to slide in perpendicular direction with respect to the axis of the inner member 23 since the synchronizing member 36 has been already disengaged from the restricting member 26. Thus, the pressure introduced in the pressure chamber 30 reliably displaces the restricting member 26 without any interference to the lower end 23B of the inner body 23.

Figure 7:
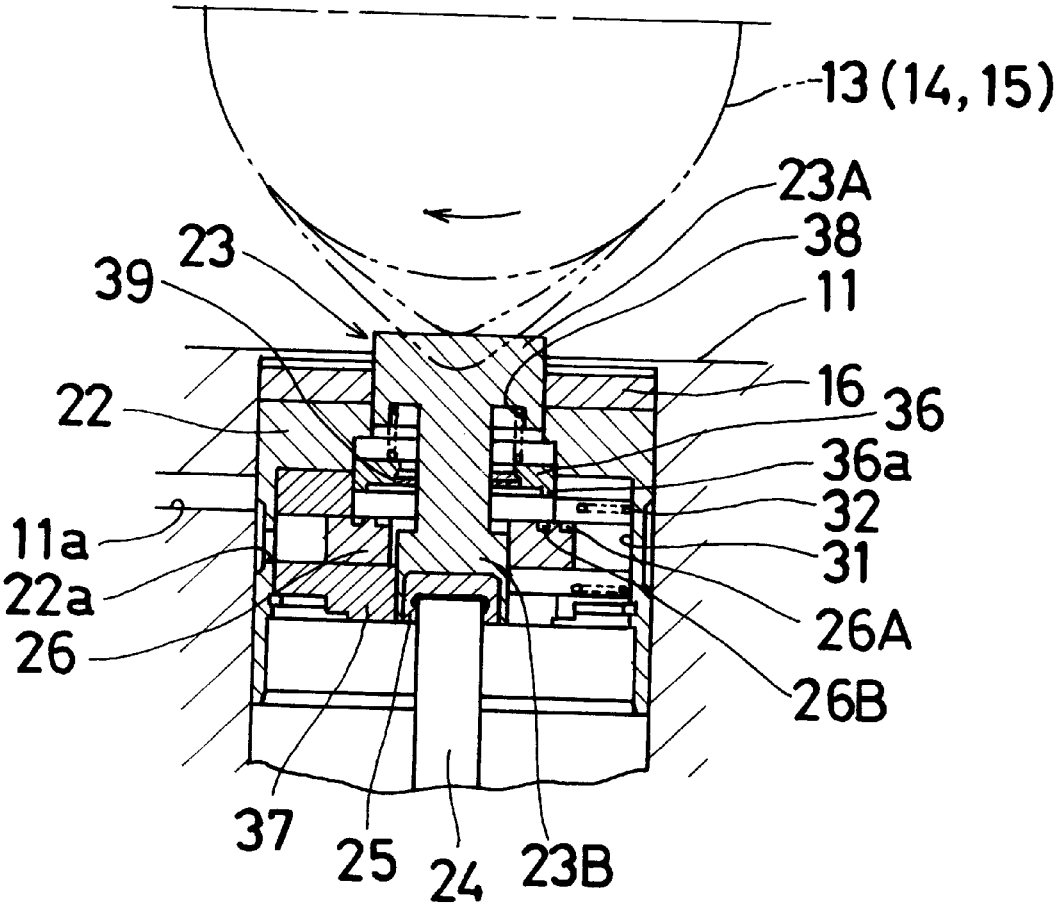
FIG. 7 shows a cross sectional view explaining the switching operation from the low lifting mode to the high lifting mode.

As shown in FIG. 7, the inner body 23 may be raised from the outer body 22 after the restricting member 26 is displaced in the second position. Accordingly, the inner body 23 and the outer body 22 will repeat following two states under the low lifting mode:

(state 1) The top surfaces of the inner member 23 and the shim 16 are flat.

(state 2) The top surface of the inner member 23 is raised from the top surface of the shim 16.

Under the low lifting mode, the synchronizing member 36 is hold by the stopper 39 around the bottom dead center S3. Further, the synchronizing member 36 is engaged with the circular channel 26B of the restricting member 26 around the top dead center.

The fluid pressure from the pump 40 may or may not be applied to the pressure chamber 30 under the low lifting mode. In case the pressure is continuously applied to the pressure chamber 30, the fluid pressure should balance with the pressure of the spring 32.

As explained above, due to the synchronizing member 36 operated by inertia applied thereto, displacement of the restricting member 26 is restricted so that the high lifting mode and the low lifting mode may be reliably switched regardless of the application timing of the fluid pressure.

Next, upon switching from the low lifting mode to the high lifting mode, the switch valve 41 takes the second position to stop the fluid pressure supplied to the pressure chamber 30. The spring 32 presses the restricting member 26 toward the pressure chamber 30 when the pressure chamber 30 loses the pressure. Under the low lifting mode, as shown in FIG. 7, the inner body 23 and the outer body 22 are mutually displaced so that the top surface of the inner member 23 is raised from the top surface of the shim 16 when the nose area B of the cams 13, 14 and 15 are in contact with the lifter 20. At this stage, the ring stopper 39 lifts the synchronizing member 36 from the restricting member 26. Subsequently, the base circle areas A1 and A2 are in contact with the cams 13, 14 and 15 so that the top surfaces of the inner member 23 and the shim 16 become flat. Thus, the restricting member 26 may be displaced by the spring 32 toward the pressure chamber 30 since the displacement path of the restricting member becomes straight between the lower end 23B of the inner body 23 and the intermediate member 37 of the outer body 22. The inner body 23 and the outer body 22 start moving integrally under the high lifting mode after the restricting member 26 is positioned at the biased position shown in FIGS. 1 and 2.

In the present embodiment, the restricting member 26 does not have to be energized at the exact timing when the inner body 23 and the outer body 22 are at the exact positions to switch to the high lifting mode from the low lifting mode. Instead, the synchronizing member 36 is apart from the restricting member 26 to release the restricting member 26 for sliding while the inner body 23 and the outer body 22 are mutually displaced. Therefore, the restricting member 26 may be energized in advance to the exact position to switch to the high lifting mode from the low lifting mode. The restricting member 26 may be displaced when the displacement path for the restricting member 26 becomes straight between the lower end 23B of the inner body 23 and the intermediate member 37 of the outer body 22. As a result, the restricting member 26 may not interfere the inner body 23 so that the restricting member 26 may effectively restrict the mutual displacement between the inner body 23 and the outer body 22.

In this embodiment, the synchronizing member 36 is lifted from the restricting member 26 so as to switch from the high lifting mode to the low lifting mode when the synchronizing member 36 can not follow acceleration of the lifter 20 due to the inertia of the synchronizing member 36. Further, mutual displacement between the inner body 23 and the outer body 22 switches the lifter 20 from the low lifting mode to the high lifting mode after disengagement of the synchronizing member 36 from the restricting member 26. Therefore, any locus of the cams 13, 14 and 15 do not have to be detected to determine the accurate switching timing. Further, fluid pressure may be applied to the lifter 20 in advance to the switching timing. In other words, the switching timing may be prescribed regardless of the application timing of the fluid pressure.

The present invention may be applied to a variable valve lifter which may stop the cam lift. For such application, the low speed cam 13 does not have to be provided. Further, amount of the nose projection may be somewhat reduced from the high speed cams 14 and 15. The high speed cams 14 and 15 press the lifter 20 while the mutual displacement between the inner body 23 and the outer body 22 is restricted by the restricting member 26. The inner member 23 does not move at all while the restricting member 26 allows the mutual displacement between the inner body 23 and the outer body 22.

In the above embodiment, the restricting member 26 is controlled by the inertia applied to the synchronizing member 36 when the lifter 20 moves upward from the bottom dead center. However, the restricting member 26 may be controlled by the inertia applied to the synchronizing member 36 when the lifter 20 moves downward from the top dead center. To do this, the synchronizing member 36 and the spring 38 may be provided between the restricting member 26 and the lower end 23B of the inner body 23 so that the projection 36*a* of the synchronizing member 36 may be engaged with the lower surface of the restricting member 26.

What is claimed is:

1. A variable valve lift device provided in a bore of a cylinder head to open and close a valve in accordance with a rotation of a cam, which comprises:

an outer body driven by the cam and slidably provided in the bore;

an inner body slidably provided in the outer body, the inner body being connected to the valve and operatively positioned along an axial direction substantially along a direction of the axis of the valve;

a restricting member for restricting mutual displacement between the outer body and the inner body; and a synchronizing member slidably provided on the inner body to slidably operate only in the axial direction of the inner body, and for controlling the restricting member based on inertia applied to the synchronizing member.

2. A variable valve lift device according to claim 1 wherein the restricting member has two circular channels and the synchronizing member has a projection that is selectively engaged with one of the circular channels.

3. A variable valve lift device according to claim 1 wherein the restricting member displaces around the top dead center of the cam.

4. A variable valve lift device according to claim 3 wherein the restricting member restricts the displacement around the bottom dead center of the cam.

5. A variable valve lift device according to claim 1 further comprising:

a pressure source for energizing the restricting member in advance to the displacement of the restricting member.

6. A variable valve lift device provided in a bore of a cylinder head to open and close a valve in accordance with a rotation of high and low speed cams, which comprises:

an outer body driven by the high speed cam and slidably provided in the bore;

an inner body driven by the low speed cam and slidably provided in the outer body, the inner body being connected to the valve and operatively positioned along an axial direction substantially along a direction of the axis of the valve;

a restricting member for restricting mutual displacement between the outer body and the inner body; and a synchronizing member slidably provided on the inner body to slidably operate only in the axial direction of the inner body, and for controlling the restricting member based on inertia applied to the synchronizing member.

7. A variable valve lift device according to claim 6 wherein the restricting member has two circular channels and the synchronizing member has a projection that is selectively engaged with one of the circular channels.

8. A variable valve lift device according to claim 6 wherein the restricting member displaces around the top dead center of the cams.

9. A variable valve lift device according to claim 8 wherein the restricting member restricts the displacement around the bottom dead center of the cams.

10. A variable valve lift device according to claim 6 further comprising:

a pressure source for energizing the restricting member in advance to the displacement of the restricting member.

* * * * *

UNITED STATES PATENT AND TRADEMARK OFFICE

CERTIFICATE OF CORRECTION

PATENT NO. :6,125,804
DATED : October 3, 2000
INVENTOR(S) : Kawai, Miyachi, Adachi, Nagae It is certified that error appears in the above-identified patent and that said Letters Patent is hereby corrected as shown below.

On the title page, item:

Item [73 ], please delete "Aisen" and insert --Aisin--

Signed and Sealed this

Eighth Day of May, 2001

*Attest:*

Nicholas P. Godici

NICHOLAS P. GODICI

*Attesting Officer*

*Acting Director of the United States Patent and Trademark Office*